US005976097A

United States Patent [19]

Jensen

[11] Patent Number: 5,976,097

[45] Date of Patent: Nov. 2, 1999

[54] DYNAMIC CONTINUOUS PASSIVE MOTION CHAIR

[76] Inventor: Robert J. Jensen, 611 NE. 2nd Ave., Stewartville, Minn. 55976

[21] Appl. No.: 08/575,871

[22] Filed: Dec. 21, 1995

Related U.S. Application Data

[63] Continuation-in-part of application No. 08/274,960, Jul. 14, 1994, abandoned.

[51] Int. Cl.[6] ..... A61H 1/00

[52] U.S. Cl. ..... 601/24; 601/26; 601/91; 601/98; 297/330

[58] Field of Search ..... 601/5, 23, 24, 601/26, 49, 50, 53, 84, 85, 86, 87, 90, 91; 297/322, 330, DIG. 4

[56] References Cited

U.S. PATENT DOCUMENTS

| | | | |
|---|---|---|---|
| 2,550,841 | 5/1951 | Martinez | 601/91 |
| 3,824,991 | 7/1974 | Whitaker | 601/26 |
| 4,061,137 | 12/1977 | Sandt | 601/26 |
| 4,768,497 | 9/1988 | Winge | 601/26 |
| 5,004,259 | 4/1991 | Ayers et al. | 297/DIG. 4 |
| 5,088,473 | 2/1992 | Chen et al. | 601/26 |
| 5,113,851 | 5/1992 | Gamba | 601/84 |
| 5,242,356 | 9/1993 | Grenfell | 601/24 |
| 5,464,382 | 11/1995 | Wang | 601/24 |
| 5,499,413 | 3/1996 | Van Hekken | 5/464 |

*Primary Examiner*—Jeanne M. Clark
*Attorney, Agent, or Firm*—Schwegman, Lundberg, Woessner, and Kluth, P.A.

[57] ABSTRACT

A device for motioning selected body portions and supporting other body portions of a user seated thereon is provided. The device comprises a base member, a peripheral member, and an ischial pad. The ischial pad is operably connected to the body member and at least partially surrounded by the peripheral member. The ischial pad undulates about two orthogonal axes and relative to the peripheral member. The ischial pad isolates and engages the right and left ischial tuberosities of the user seated on the device for simulating the natural motion of the user's spine. The peripheral member supports the user's body portions proximate the ischium.

7 Claims, 12 Drawing Sheets

DYNAMIC CONTINUOUS PASSIVE MOTION CHAIR

REFERENCE TO CO-PENDING APPLICATION

This patent application is a continuation-in-part of patent application Ser. No. 08/274,960 filed Jul. 14, 1994, now abandoned.

BACKGROUND OF THE INVENTION

The present invention is directed to a device suitable for providing a user's pelvic and upper body portions with dynamic continuous passive motion. Specifically, the present invention is directed to a device suitable for use as a seat wherein operation of the device with a user seated thereon provides undulatory movement of the seat for simulating the natural biomechanics of the spinal column, musculoskeletal system, soft tissues and fluid movement of the body.

Passive motion, by definition, refers to any movement of an articulation, body part or tissue that is produced by some external force. The source of the motion is any force other than the neuromuscular units that would normally be powering the motion under voluntary control. Passive motion may be placed on a spectrum extending from almost complete immobilization to continuous, uninterrupted movement.

Clinical observations reveal deleterious effects of prolonged immobilization of joints and tissues in patients. Clinical observations also have shown the beneficial local effects of early active motion as opposed to prolonged immobilization of diseased and injured body parts. Also, motion of the spine and extremities of paraplegic or quadriplegic patients reduce their susceptibility to necrosis, or pressure sores, resulting from prolonged immobilization. Continuous passive motion has been demonstrated to be extremely helpful for those with spinal injuries. Additionally, continuous passive motion has been demonstrated to be helpful to otherwise healthy individuals subject to prolonged immobilization such as office workers, motor vehicle operators and passengers, jurors, or the like.

It is well known that the biomechanics of the spine put the body into six degrees of motion (flexion, extension—right and left, rotation—right and left, lateral bendings, as well as long-axis distraction and compression or load/unload cycles). During the normal gate cycle, the spine is in a lordotic position wherein the portions of the spine receive a circumductive load and unload force. This load and unload cycle occurs each time a step is taken as gravity forces the body downward. This cycle, or pumping action creating a load/unload cycle, has with it a slight rotational component as the arms swing and the legs step alternately.

Those confined to a wheelchair, suffering from spinal injuries, or otherwise healthy individuals subjected to prolonged immobilization are not able to put the spinal column in active motion, or otherwise, to promote the benefits of passive motion and the circulation of blood through the spine/pelvic region and legs. For the foregoing reasons, there is a need for a device to simulate the natural undulatory movement and the redistributing weight bearing structures of the spine through continuous passive motion.

One such device is shown in U.S. Pat. No. 5,113,851 to Gamba, which shows a chair that automatically and continuously tilts and oscillates in such a way as to change the position of the body of the person seated on the chair. It has been determined, however, that chairs such as that shown in the Gamba suffer from disadvantages. For example, the entire seat of the Gamba chair is put in motion, which translates into movement of the legs, hips, and spine, etc. It has been determined that more effective pertinent exercise is provided when the spine is isolated. Thus, moving the legs, etc., is an inefficient use of power. General lower body motion of the type described above, in addition to being inefficient, can also create discomfort in many individuals.

SUMMARY OF THE INVENTION

The present invention is directed to a device for motioning selected body portions and supporting other body portions of a user seated thereon. The device comprises a base member, a peripheral member, and an ischial pad. The ischial pad is operably connected to the body member and at least partially surrounded by the peripheral member. The ischial pad undulates about two orthogonal axes and relative to the peripheral member. The ischial pad isolates and engages the right and left ischial tuberosities of the user seated on the device for simulating the natural motion of the user's spine. The peripheral member supports the user's body portions proximate the ischium.

DETAILED DESCRIPTION OF THE PREFERRED EMBODIMENTS

Figure 1:
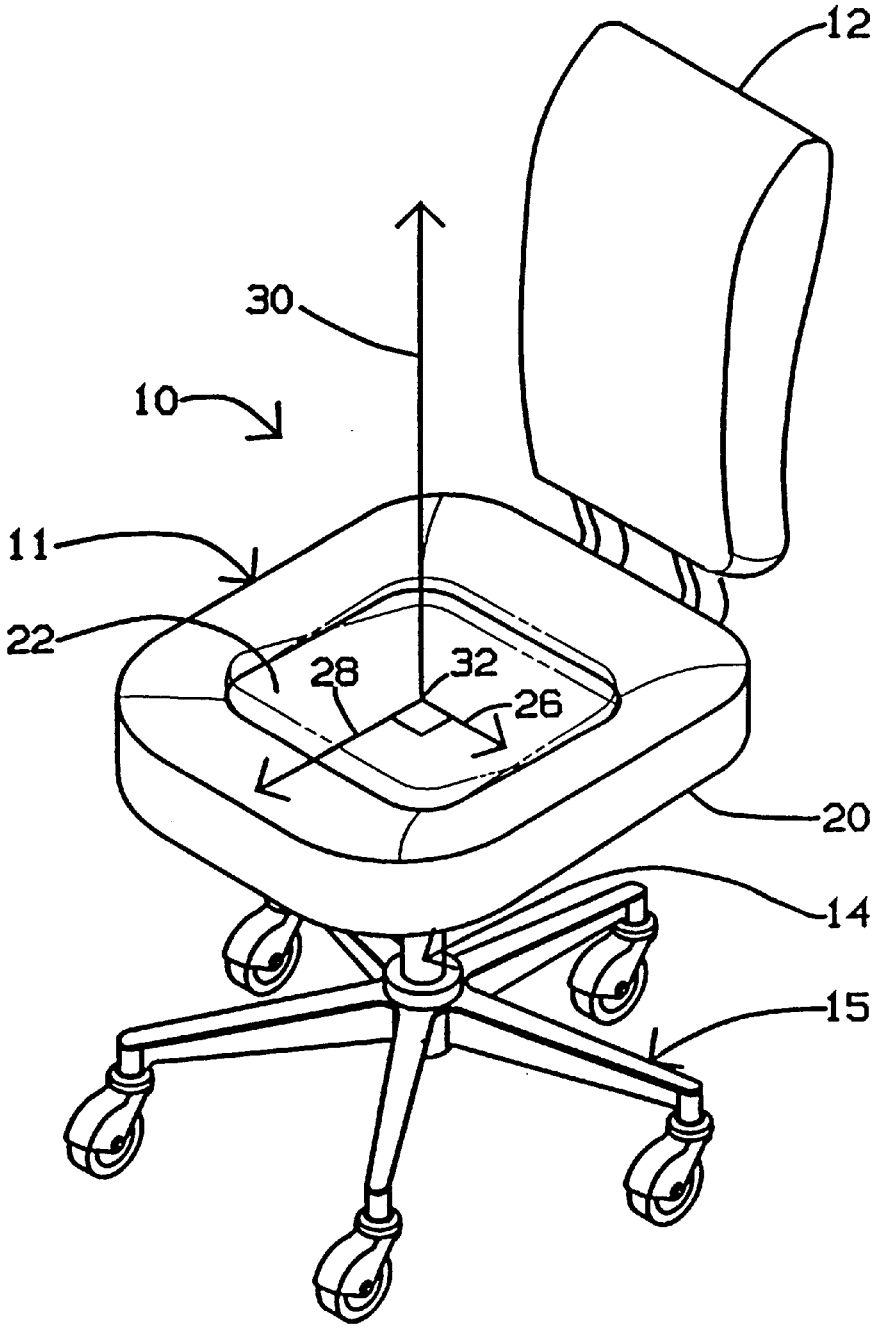
FIG. 1 shows a perspective view of a device embodying features of the present invention.

Referring to FIG. 1, there is provided a chair embodying features of the present invention and indicated generally at 10. It is to be understood, however, that other embodiments are contemplated as will become apparent to those skilled in the art. The chair 10 includes a seat 11, seat back 12, chair support 14, and legs 15. The chair may also include features such as a head rest or arms (not shown). The seat 11 comprises a peripheral member 20 and an ischial pad 22 movable relative to the peripheral member 20. As a user sits in the chair 10, the ischial pad 22 underneath the user preferably isolates and undulates the right and left ischium and sacral area of the user while the peripheral member 20 supports the user's body portions proximate the ischium and when in operation continuously redistributes normal pressures and stress build-ups over the weight bearing structures within the spinal column, as well as pumping fluids through the soft tissues.

The undulatory motion of the ischial pad 22 relative to the peripheral member 20 is described with reference to FIG. 1. Simply put, the ischial pad 22 rotates about two orthogonal axes defining an ischial plane 60 (show in FIG. 2A), otherwise known as the pitch and roll axes, 26 and 28, respectively. Preferably, the ischial pad 22 does not rotate about the yaw axis 30. The intersection point of axes 26, 28 and 30, indicated at 32, theoretically and preferably does not move relative the peripheral member 20.

Figure 2A:
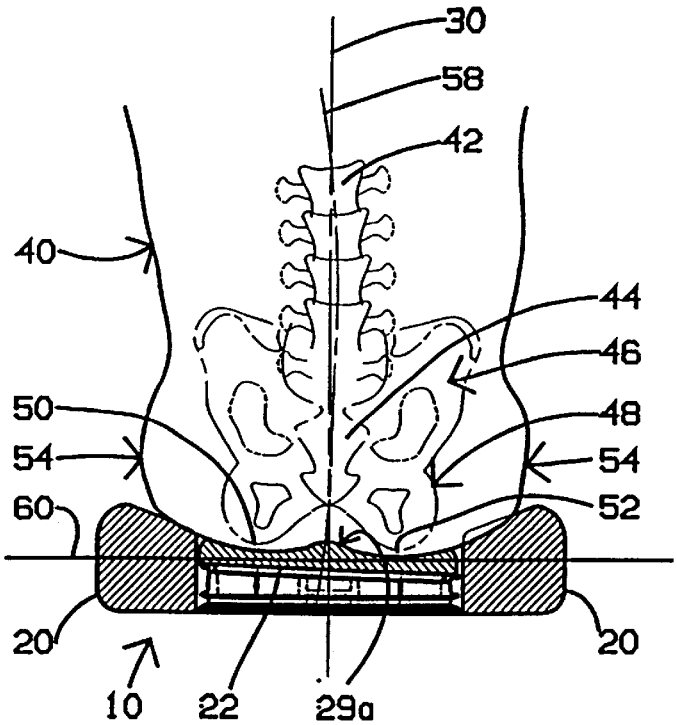
FIGS. 2A–2D show a partially sectioned side views of the device of FIG. 1 having a user seated thereon and indicating the skeletal structure of the user.

The effect of the undulatory movement of the ischial pad 22 and support of the peripheral member 20 on a user seated thereon is described with reference to FIGS. 2A–2D. FIG. 2A shows body portions of user 40 such as lumbar spine 42, sacrum 44, ilium 46, ischium 48 including left and right ischial tuberosities 50, 52, respectively, and body portions indicated at 54 proximate the ischium 48, including lateral femoral muscles, gluteal muscles, buttocks, and the like. The curvature accommodation of the spine 42 is indicated at 58. The ischial pad 22 preferably engages, isolates and undulates the left and right ischial tuberosities 50, 52, while the peripheral member 20 supports the proximate body portions 54 which are held generally and relatively stationary with respect to the ischial pad 22.

FIG. 2A is a partially sectioned view of a portion of chair 10 from behind the user 40 showing the ischial pad 22 fully rotated with respect to the ischial plane 60 in a first direction 29*a* about the roll axis 28 relative the peripheral member 20. At this position, there is no rotation about the pitch axis 26 with respect to the ischial plane 60. Axis 32 is perpendicular to the ischial plane 60. The left ischial tuberosity 50 is above the right ischial tuberosity 52 relative ischial plane 60 inducing a spinal curvature 58 generally concave left.

Figure 2B:
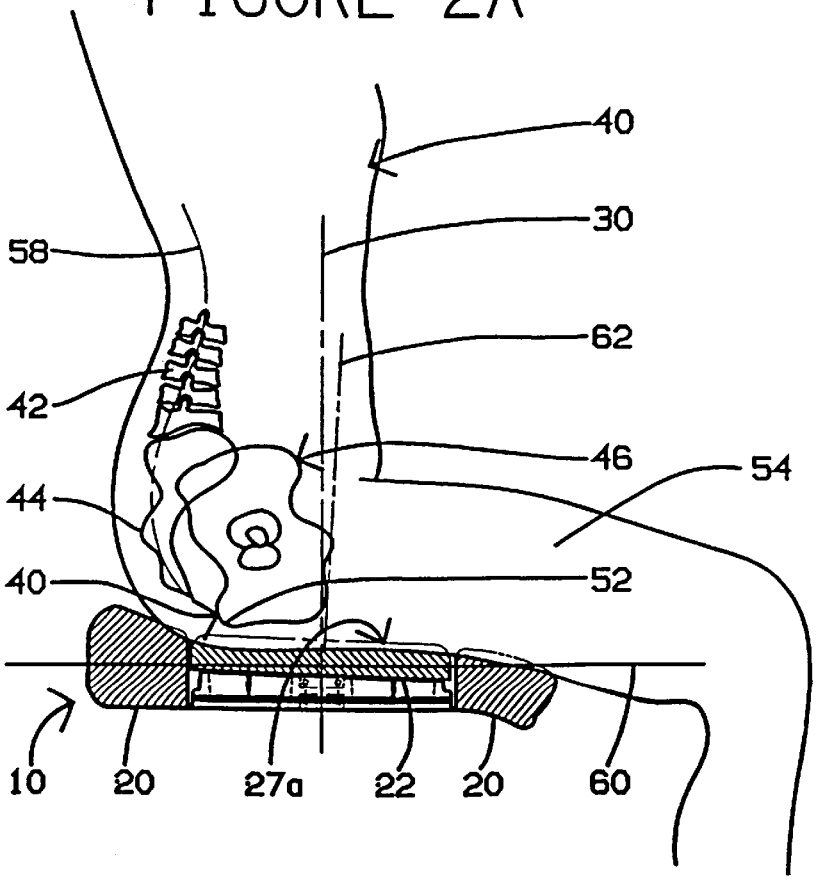

FIG. 2B shows a partially sectioned view of a portion of chair 10 the right side of the user 40 wherein the ischial pad 22 is tilted to a forward position and fully rotated with respect to the ischial plane 60 in a second direction 27*a* about the pitch axis 26 relative the peripheral member 20. At this position, there is no rotation about the roll axis 28 with respect to the ischial plane 60. As the ischial pad 22 moves from the position shown in FIG. 2A to the position shown in FIG. 2B, it gradually decreases roll in the first direction while it gradually increases pitch in the second direction 27*a* relative the peripheral member 20. Axis 62 is preferably perpendicular to the surface of the ischial pad 22. From the position shown in FIG. 2B, the ischial pad 22 gradually decreases pitch in the second direction and increases roll opposite the first direction relative the peripheral member 20 to the position shown in FIG. 2C.

Figure 2C:
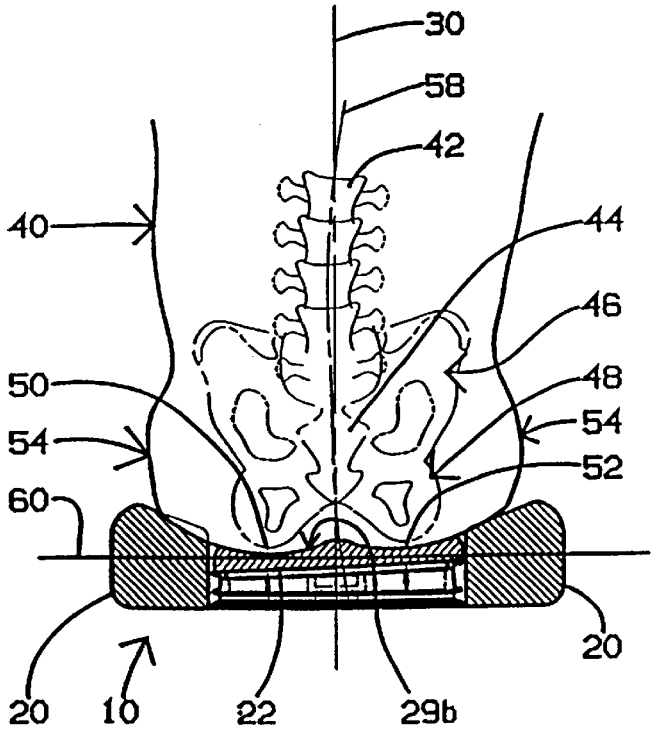

FIG. 2C is another partially sectioned view of a portion of the chair 10 from behind the user showing the ischial pad 22 fully rotated with respect to the ischial plane 60 in the direction opposite the first direction 29*a* about the roll axis 28 (i.e., rolls in third direction 29*b*, opposite first direction 29*a*). At this position, the right ischial tuberosity 52 is above the left ischial tuberosity 50 relative the ischial plane 60 inducing a spinal curvature 58 generally concave right. The spine 42 has rotated 180° through its movement from the position shown in FIG. 2A. From the position shown in FIG. 2C, the ischial pad 22 gradually increases roll in the first direction while it increases pitch in a direction opposite the second direction (i.e., pitches in fourth direction 27*b*, opposite second direction 27*a*) relative to the peripheral member 20 to the position shown in FIG. 2D.

Figure 2D:
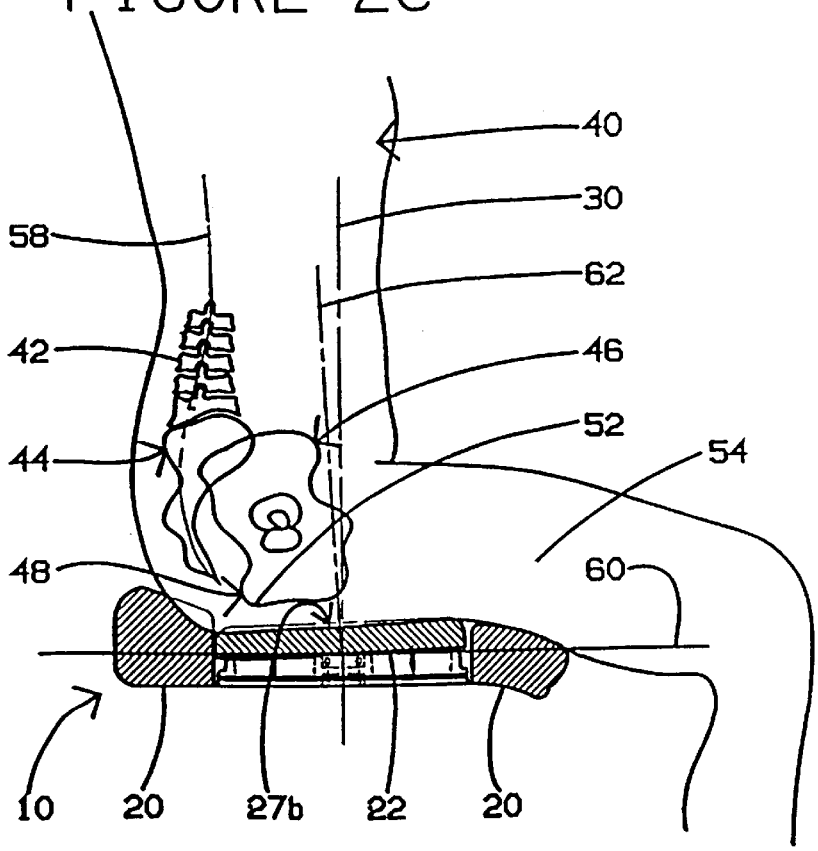

FIG. 2D shows a partially sectioned view of a portion of the chair 10 from the left side of the user wherein the ischial pad 22 is tilted to an aft position and fully rotated with respect to the ischial plane 60 in the fourth direction 27*b*, direction opposite the second direction 27*a*, about the pitch axis 26 relative the peripheral member 20. At this position, there is no rotation about the roll axis 28 with respect to the ischial plane 60. From this position, the ischial pad 22 moves relative to the peripheral member 20 so as to increase roll in the first direction 29*a* and increase pitch in the second direction 27*a* to the position shown in FIG. 2A. As the spine 42 moves from a starting point shown, for example, in FIG. 2A through FIGS. 2B–2D to return to its position shown in FIG. 2A, it rotates 360° through its movement.

The ischial pad 22, through its undulatory movement, effects continuous passive motion to the spine 42. By isolating and engaging the ischium, particularly the right and left ischial tuberosities 50 and 52, the ischial pad effectively directs the continuous passive motion to where it provides significant benefit, i.e., the spine 42. Motion to the proximate body portions 54 is dampened by the peripheral member 20. The ischial pad 22 when used in combination with the peripheral member 20 efficiently directs motion to where it is most beneficial while dampening motion to the proximate body portions 54 which remain relatively generally stationary thereby promoting user comfort. The user 40 is provided with the benefits of continuous passive motion while not annoyed with distractions such as bouncing legs or wobbling hips.

Figure 3:
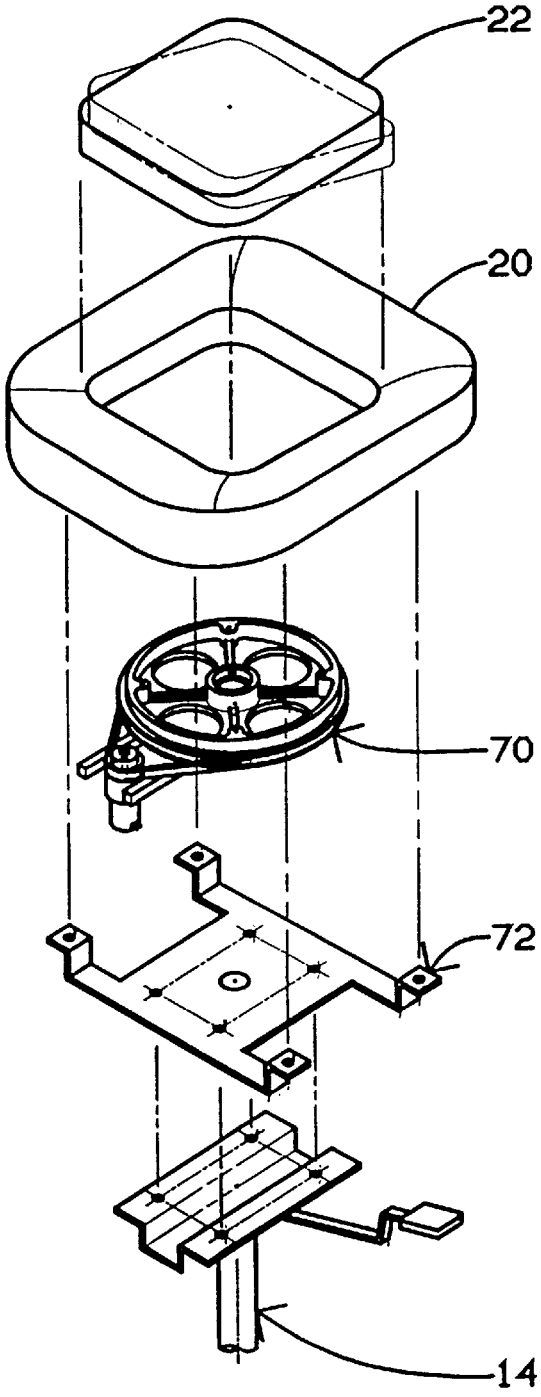
FIG. 3 shows an exploded view of a portion of the device of FIG. 1.

A preferred means for effecting the above-described undulatory motion and peripheral support is shown generally in FIG. 3, which is an exploded view of a portion of the chair 10 of FIG. 1. FIG. 3 shows a wobble member 70 adapted to engage the ischial pad 22 and effect undulatory motion thereto. Alternative versions of the wobble member are contemplated, of course. A chair base 72 supports the wobble member 70 and the peripheral member 20, which are attached thereto. The base 72 can be disposed on the chair support 14.

Figure 4:
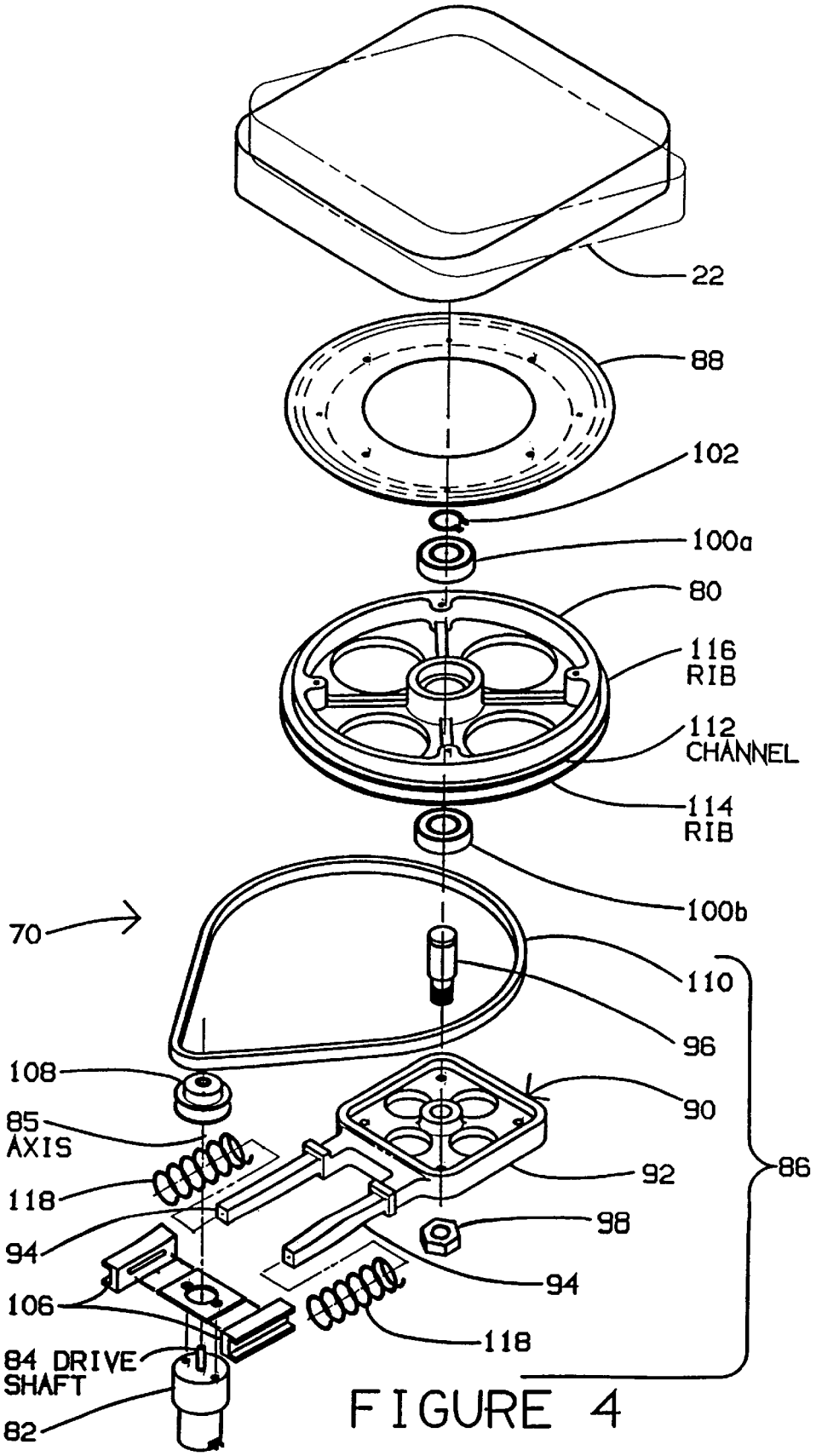
FIG. 4 shows an exploded view of a portion of the device of FIG. 1 as shown in FIG. 3.

FIG. 4 shows an exploded view of the wobble member 70 of FIG. 3. Wobble member 70 comprises a wedge wheel 80, a motor 82 having drive shaft 84, and coupling assembly indicated generally 86, coupling the drive shaft 84 to the wedge wheel 80 thereby transferring power from the motor 82 to rotate the wedge wheel 80. As shown, the drive shaft 84 is on drive shaft axis 85 which is generally perpendicular to yaw axis 30, not shown. The wedge wheel 80 is connected to the ischial pad 22 by a top seat bearing 88 of a known construction. For example, Triangle Manufacturing Co. of Oshkosh, Wisconsin, manufactures a suitable bearing.

The coupling assembly 86 comprises a mount base 90 preferably disposed parallel to the ischial plane 60 (not shown) while in use, and having a mount member 92 and a pair of mount rails 94. The wedge wheel 80 is rotatably attached to the mount member 92 by means of a threaded center pin 96 secured to the mount member 92 by nut 98. The wedge wheel 80 is supported by thrust bearings 100*a* and 100*b* permitting rotation of the wedge wheel 80 with respect to the mount base 90. The wedge wheel 80 is secured to the threaded center pin 96 by means of retaining ring 102.

The motor is attached to a motor mount plate 104 in a known manner. Mount blocks 106 engage the motor mount plate 104 and are adapted to slide along mount rails 94. Mount blocks 106 preferably provide a means for dampening motor vibration and reducing the transfer of motor vibration to the mount base 90. Drive shaft 84 is connected to a sprocket 108. The sprocket 108 engages an endless belt 110 which is wrapped around the wedge wheel 80 and within channel 112 defined between ribs 114 and 116 on the wedge wheel 80. Tension is provided to the belt 110 through springs 118 which yieldably urge the mount blocks 106, and consequently the motor 82 away from the mount member 92, and, consequently, the wedge wheel 80.

Figure 5:
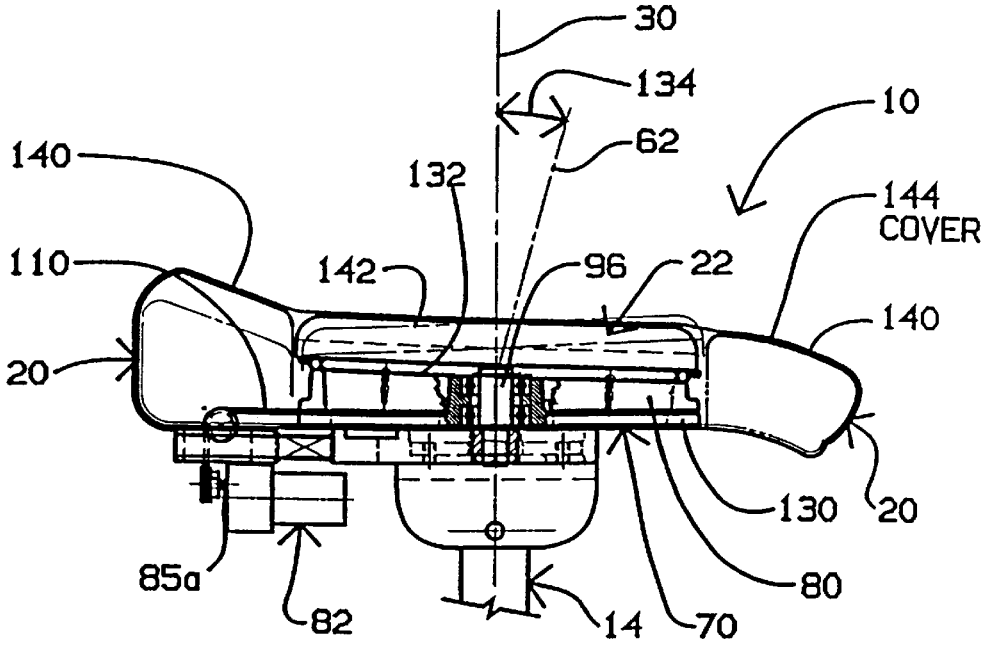
FIG. 5 shows a sectioned side view of a portion of the device of FIG. 1.

FIG. 5 is a partial sectional side view of the chair of FIG. 1. FIG. 5, however, shows the drive shaft axis 85*a* generally perpendicular to yaw axis 30, and otherwise like parts are indicated with like reference numbers. The wedge wheel 80 includes two opposite nonparallel faces 130, 132. The wedge wheel 80 is mounted to the mount base 90 such that bottom face 130 is generally parallel thereto. As such, bottom face 130 is generally parallel to the ischial plane 60 when in use. Top face 132 is preferably perpendicular to axis 62. The wedge wheel rotates about the center pin 96 which is generally congruent with the yaw axis 30 and at a fixed circumductive angle 134 with respect to axis 62. Top seat bearing 88 preferably isolates the rotation of the wedge wheel 80 about the yaw axis 30 from the ischial pad 22. Rotation of the wedge wheel 80 thereby effects undulatory motion to the ischial pad 22. Peripheral member 20 and ischial pad 22 preferably include cushions 140, 142, respectively, and a cover 144 stretched thereacross.

Figure 6:
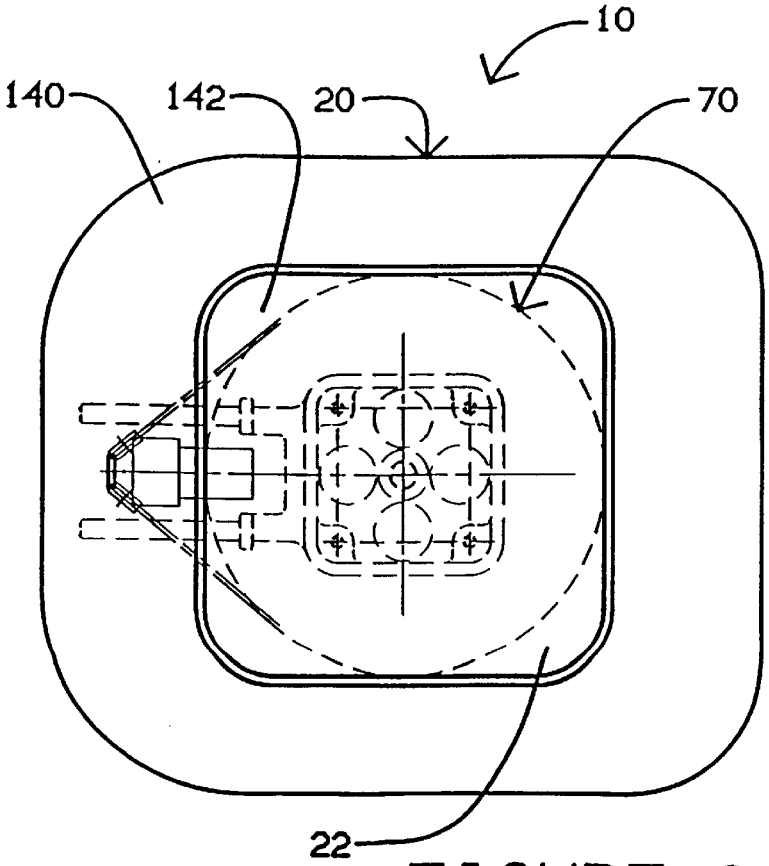
FIG. 6 shows a top view of a portion of the device of FIG. 1 as shown in FIG. 5.

FIG. 6 shows a top view of the portions of the chair 10 depicted as in FIG. 5 wherein the wobble member 70 is shown in phantom. Cushion 140 is preferably an annular cushion surrounding cushion 142. In the embodiment shown, the ischial pad 22 is generally rectangular with rounded corners. It is to be understood that other configurations of the ischial pad 22 are contemplated and suitable. For example, the ischial pad 22 can be round, elliptical, or the like. Additionally, the ischial pad 22 can be contoured. The ischial pad 22 can be varied in size depending on the needs of the user. The peripheral member 20 is preferably formed to comfortably support the user 40 in a seated position.

Figure 7:
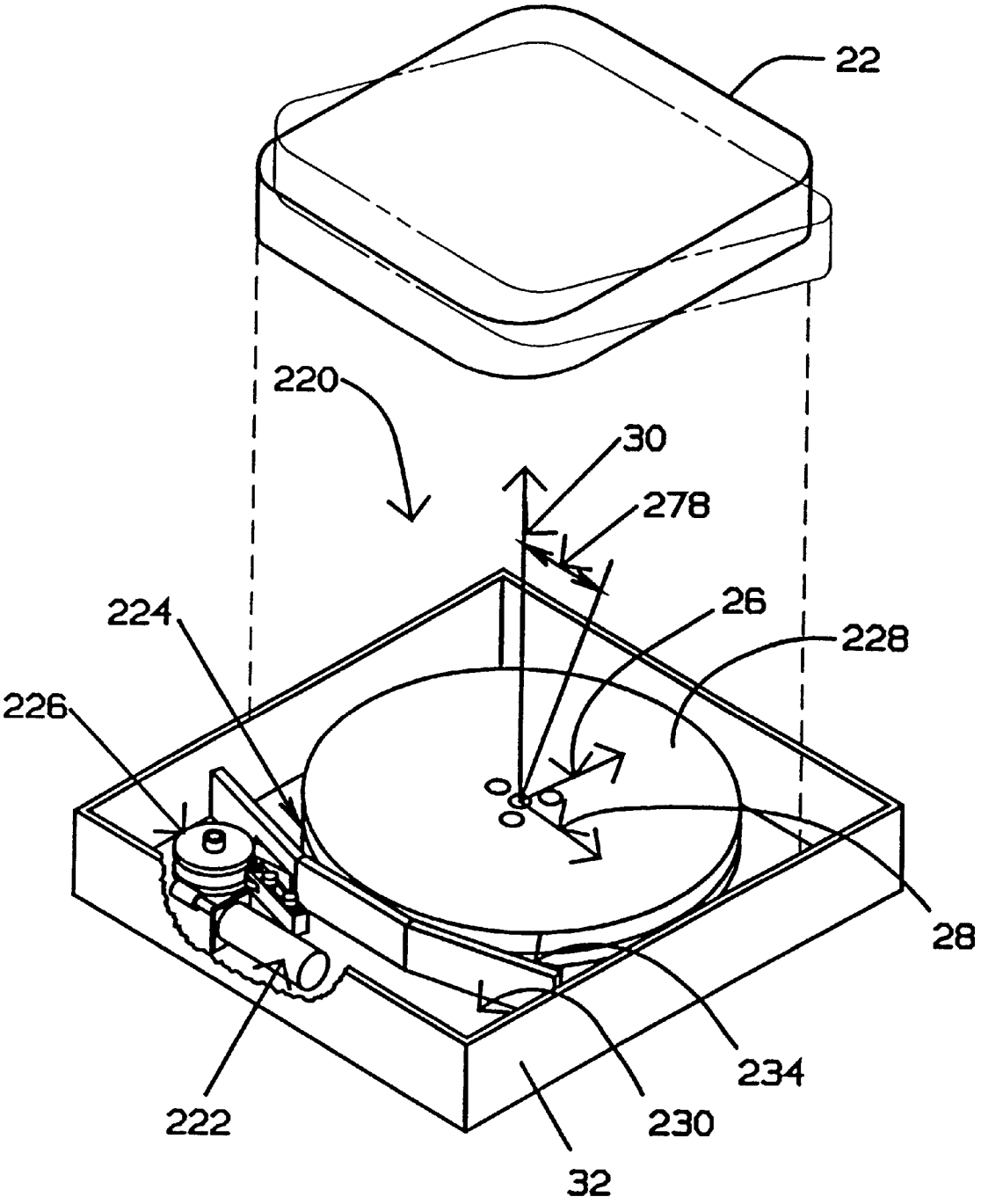
FIG. 7 is a perspective view of another device embodying features of the present invention.

FIG. 7 is a perspective view of another device embodying features of the present invention, and indicated generally at 220 wherein like parts have like reference numerals. The device 220 includes an electric motor 222 which rotates a wedge wheel 224 through a coupling assembly 226. The wedge wheel 224 rotatably engages a wobble plate 228 which is adapted to be rigidly attached to the ischial pad 22, indicated in FIG. 7. The wedge wheel 224 rotates about yaw axis 30 relative the wobble plate 228, which effects undulatory movement thereto. The wedge wheel 224 is rotatably attached to a base plate 230 preferably having a bulkhead 234. The base plate 230 and bulkhead 234 are preferably adapted to support the peripheral member 20, and suitable for attachment to the chair support 14.

Figure 8:
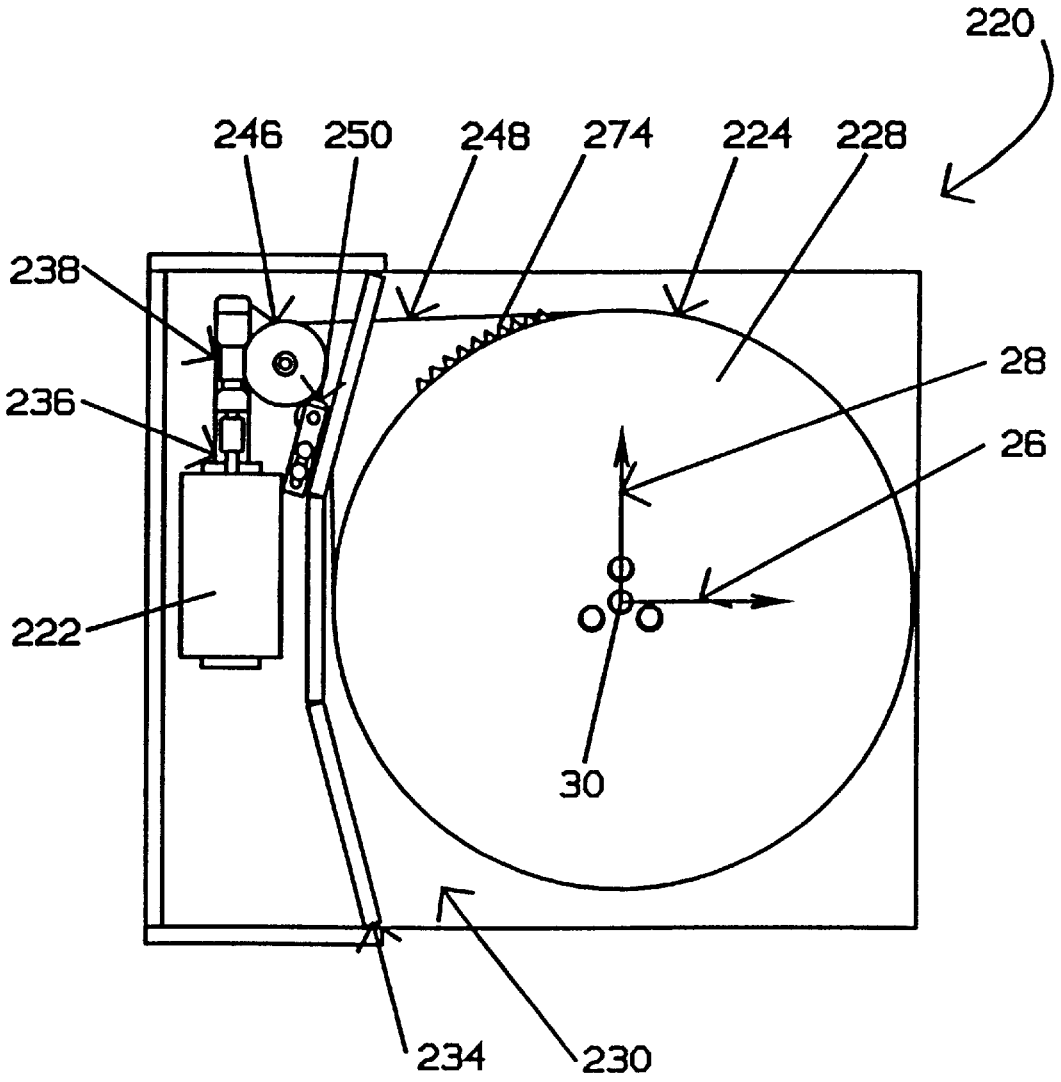
FIG. 8 is a top view of the device of FIG. 7.

FIG. 8 is a top view of device 220. The motor 22 is attached to the base plate 230 and rotates a drive shaft 236 carrying a worm 238. In the embodiment shown, the drive shaft 236 is generally perpendicular to the yaw axis 30. The worm 238 engages a worm gear (not shown) in a plane parallel to the base plate 230 and connected to sprocket gear 246 affixed to the worm gear and coaxial therewith. The sprocket gear 246 engages an endless drive chain 248 which is wrapped around the wedge wheel 224 and engages a plurality of gear teeth 274 bonded to the side of the wedge wheel 224. An idler sprocket 250 removably engages the drive chain 248 proximate the sprocket 246 to hold the drive chain 248 in place during operation. The idler sprocket 250 can be retracted to permit removal of the chain 248.

Figure 9:
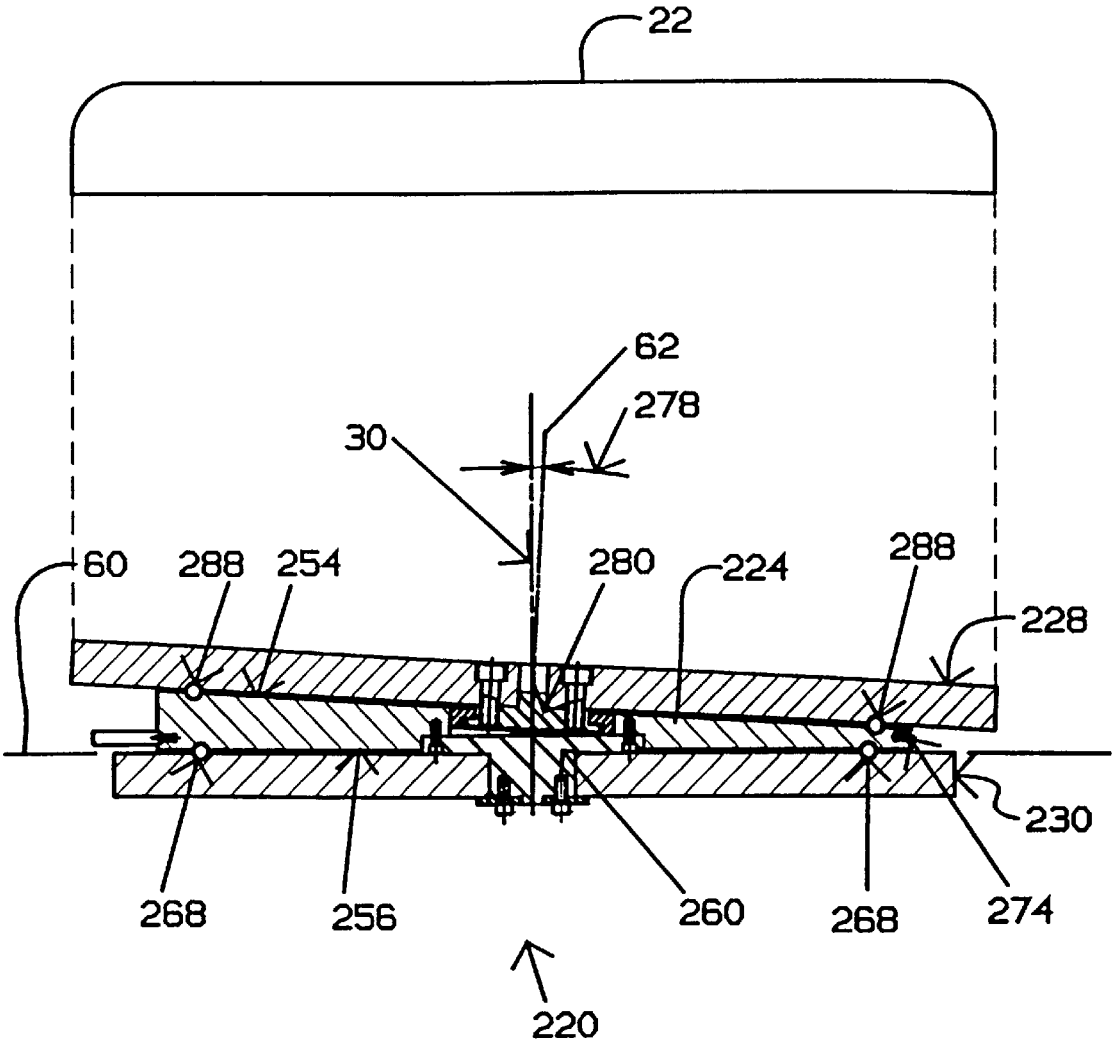
FIG. 9 is a side sectional view of a portion of the device of FIG. 7.

FIG. 9 is a side sectional view of a portion of device 220 showing the base plate 230, wedge wheel 224, wobble plate 228, and related components described below. The wedge wheel 224 includes two opposite non-parallel faces 254, 256. The wedge wheel 224 is rotatably mounted to the base plate 230 such that the bottom face 256 is preferably generally parallel to the base plate 230. A bottom center pin 260 is affixed to the wedge wheel 224 and rotatably attached to the base plate 230. A plurality of ball bearing assemblies 268 mounted between the wedge wheel 224 and base plate 230 permit low friction of the rotation of the wedge wheel 224 relative the base plate 230. The wedge wheel 224 rotates about the bottom center pin 260 which is generally congruent with the yaw axis 30.

The wobble plate 228 is rotatably mounted to the wedge wheel 224 at the top face 254 by means of a top center pin 280. A plurality of ball bearing assemblies 288 disposed between the wobble plate 228 and wedge wheel 224 permit low friction rotation of the wedge wheel 224 relative to the wobble plate 228. As the wedge wheel 224 rotates above the bottom center pin 260 relative to the base plate 230, the top face 254 rotates at a fixed circumductive angle 278 with respect to the yaw axis 30. As such, the wedge wheel 224 effect undulatory movement to the wobble plate 228.

Figure 10:
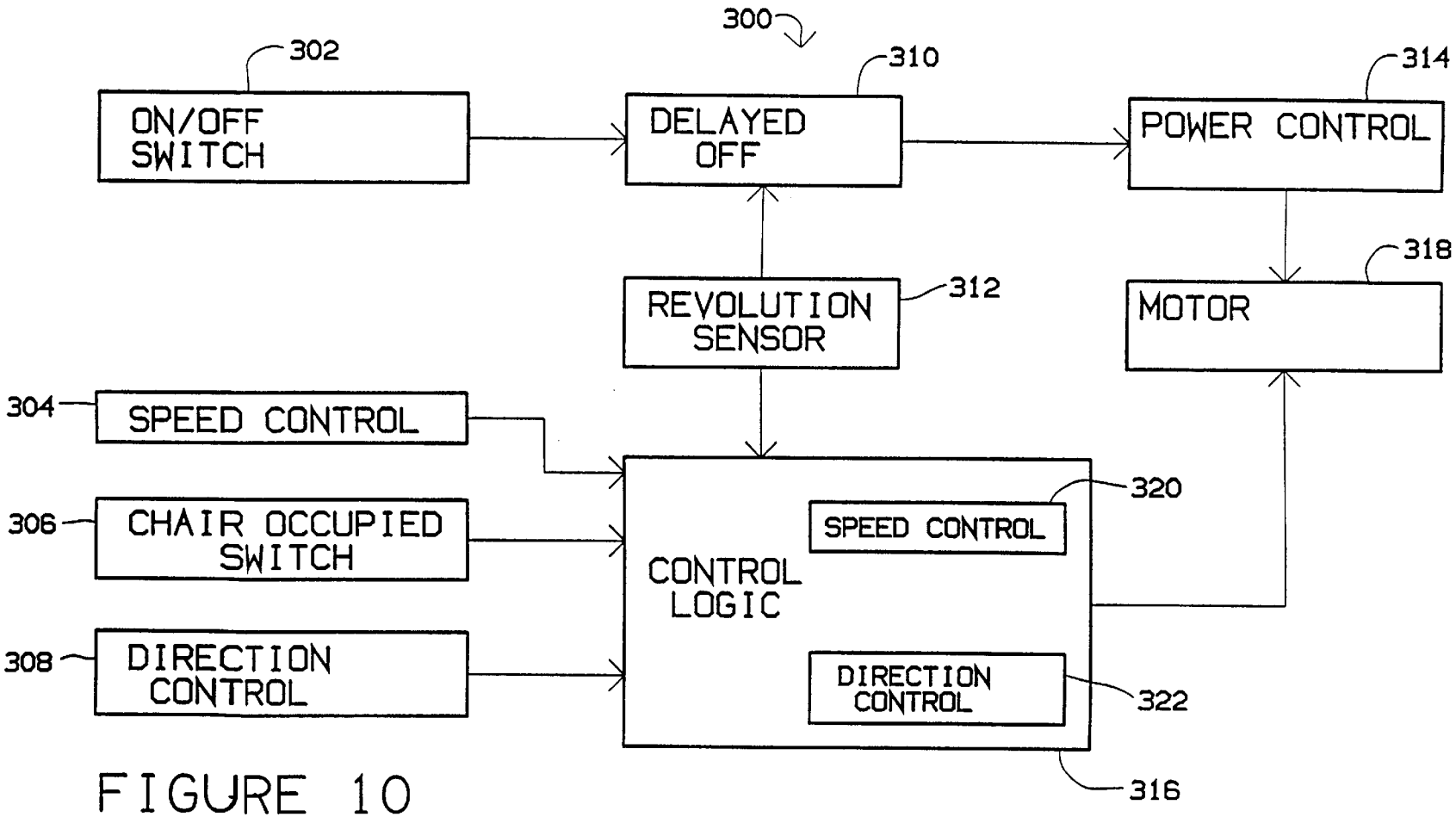
FIG. 10 is a block diagram of a portion of the device of FIG. 1.

In each of the above described embodiments the wobble members are powered by an alternating current or battery (not shown) which can be attached to the device. The device can include merely an on/off switch for sending power to the motor or can include any number of various electronically controlled features. One embodiment of the electronic controls is shown in block diagram form in FIG. 10 and indicated generally at 300. Controls 300 include such features as an on/off switch 302, speed control 304, chair-occupied switch 306 and direction control 308. The electronic control 300 preferably also includes features such as a delayed off 310, revolution sensor 312, power control 314, and control logic 316. The motor is indicated at 318. The speed control 304, chair-occupied switch 306, and direction control 308 are input into the control logic 316 which in turn controls the motor 318. The user can adjust the rotation speed of the wedge wheel with the speed control 304. The rotation speed can be set at a desired rate and depends on predetermined requirements, user comfort, or both. Preferably, the wedge wheel rotates at about between 0.5 rpm and 3.0 rpm. The user occupied switch 306 senses whether a user is seated on the device, and stops rotation of the wedge wheel when the chair is unoccupied, independent of the on/off switch 302. When the device is occupied thereafter, the user occupied switch 306 directs the control logic 316 to resume rotation from where it left off. It is to be understood that the direction of rotation of the wedge wheel, either clockwise or counterclockwise, for example, can also be user controlled by an external direction control 308. The on/off control 302 and direction control 308 can be combined in a three-way switch in a manner now known to those skilled in the art.

The revolution sensor 312 determines the position of the wedge wheel and can also determine the speed and direction thereof, and provides an input to the control logic 316. For example, if the device is powered by a battery, the speed of rotation may slow as the battery is drained. The revolution sensor 312 can indicate the slow down to the control logic, which through an automatic speed control (indicated at 320 but preferably incorporated in control logic 316), can compensate for the slow down so that the motor 318 can drive the wedge wheel at a generally constant rate. In addition to the automatic speed control 320, the control logic 316 can also include an automatic direction control (indicated at 322 but preferably incorporated into control logic 316) which can automatically vary the direction of rotation of the wedge wheel based on selected requirements. Additionally, the automatic direction control 322 can randomly vary the direction of rotation of the wedge wheel after every predetermined rotations.

The electronic control 300 can also include a delayed off 310 which moves the wedge wheel to a predetermined stopping position as indicated by the revolution sensor 312 when the on/off switch 302 is set to "off". Afterwards, the delayed off 310 provides a signal to the power control 314 to stop rotation and power down the device.

Figure 11A:
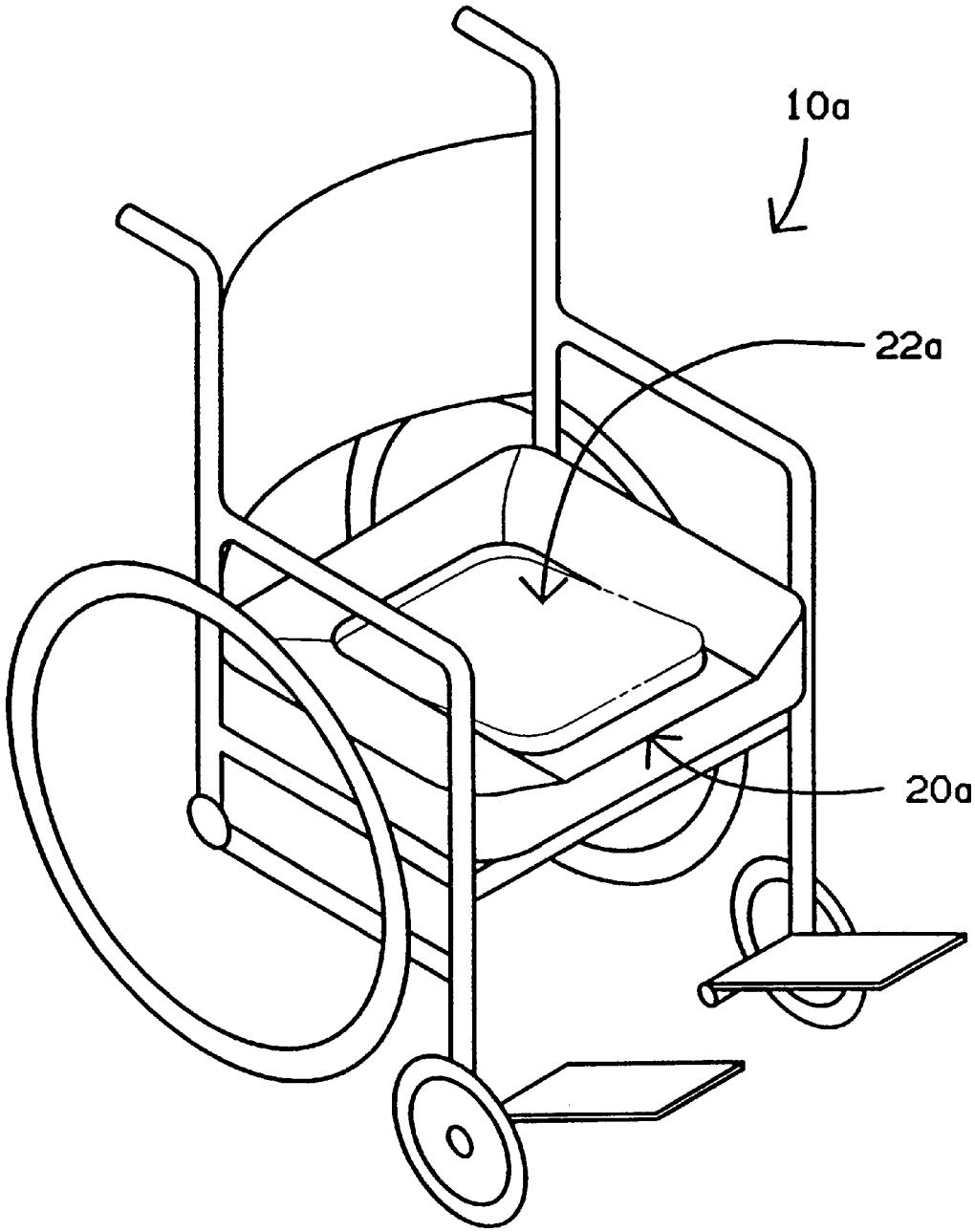
FIGS. 11A and 11B show additional embodiments of the present invention.
Figure 11B:
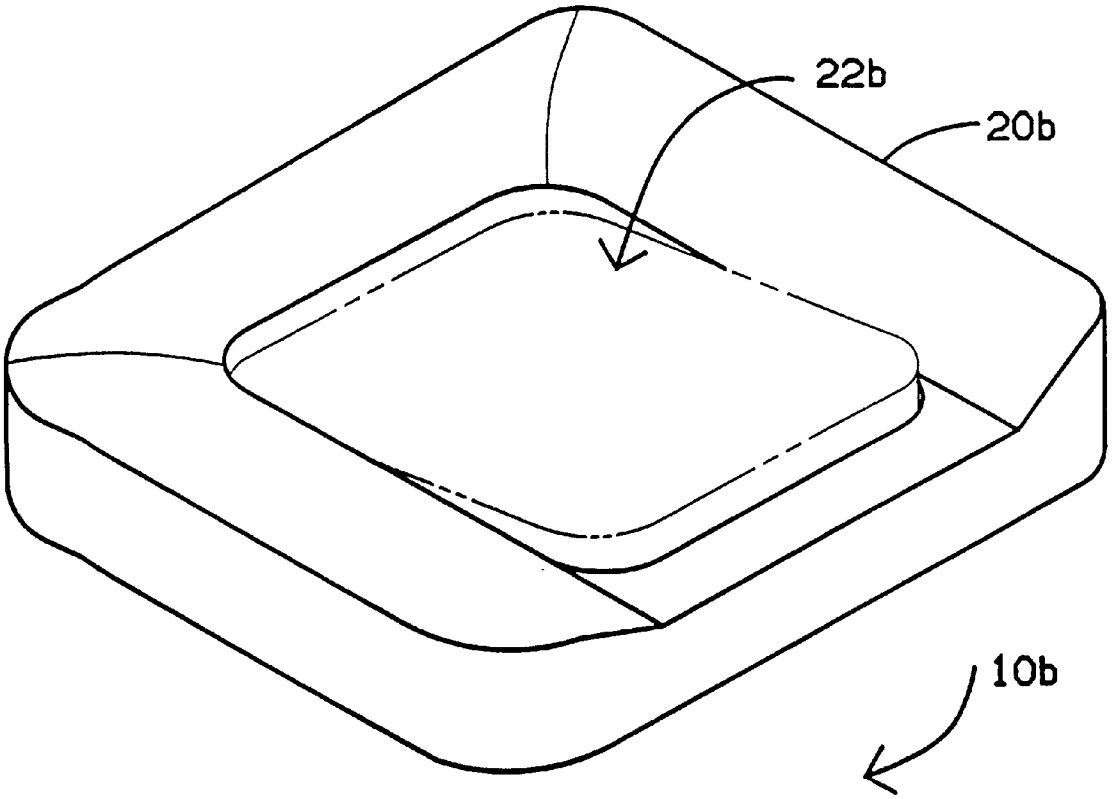

FIGS. 11A and 11B show two alternative embodiments of the chair 10 shown in FIG. 1. For example, the wheel chair 10*a* shown in FIG. 11A also includes an ischial pad 22*a* surrounded by a peripheral member 20*a*. A wobble member (not shown) located under the ischial pad 22*a* effects undulatory motion thereto relative the peripheral member 20*a*. Additionally, the portable seat 10*b* shown in FIG. 11B includes ischial pad 22*b* partially surrounded by peripheral member 20*b*. A battery, control electronics, and wobble member (not shown) are contained within the portable seat 10*b* which can be transported with the user to provide exercise whenever the user is subject to prolonged immobilization. Of course, the portable seat 10*b* can also be provided with a peripheral member which completely surrounds the ischial pad 22*b*, as indicated above.

Although the present invention has been described with reference to preferred embodiments, workers skilled in the art will recognize that changes may be made in form and detail without departing from the spirit and scope of the invention.

What is claimed is:

1. A chair, comprising:

a frame;

a peripheral member attached to the frame; and a wobble member operably coupled to the frame, the wobble member having an ischial pad rotatably mounted thereon, the ischial pad disposed within the peripheral support member wherein the wobble member effects undulatory movement of the ischial pad about two orthogonal axes and relative the peripheral member wherein:

the wobble member comprises a wedge wheel having a top face and engaging the ischial pad, the wedge wheel rotatable about a main axis and relative to the frame, wherein the main axis is generally perpendicular to the orthogonal axes so that the top face rotates at a generally fixed circumductive angle with respect to the main axis;

a motor having a drive shaft; and a coupling assembly operably coupling the wedge wheel to the motor wherein the coupling assembly includes:

a mount base having a mount member and two mount rails wherein the wedge wheel is rotatable attached to the mount member and the motor is connected to the mount rails;

an endless belt engaging the wedge wheel and coupled to the drive shaft; and a spring yieldably urging the motor along the mount rails and away from the mount member for providing tension to the endless belt;

wherein the ischial pad engages and isolates the right and left ischial tuberosities and sacral area of a user seated in the chair and the peripheral member supports the user's body portions proximate the right and left ischial tuberosities.

2. The chair of claim 1 and further comprising a cushion and cover attached across the peripheral member and covering the ischial pad.

3. The chair of claim 1 and further comprising a pair of mount blocks coupling the motor to the mount rails wherein the mount blocks dampen motor vibration.

4. The chair of claim 1 and further comprising a top seat bearing rotatably connecting the wedge wheel to the ischial pad.

5. The chair of claim 1 wherein the drive shaft rotates about a drive axis and wherein the drive axis is one of generally parallel and generally perpendicular to the main axis.

6. A chair, comprising:

a frame;

a peripheral member attached to the frame; and a wobble member operably coupled to the frame, the wobble member having an ischial pad rotatably mounted thereon, the ischial pad disposed within the peripheral support member wherein the wobble member effects undulatory movement of the ischial pad about two orthogonal axes and relative the peripheral member wherein:

the wobble member comprises a wedge wheel having a top face and engaging the ischial pad, the wedge wheel rotatable about a main axis and relative to the frame, wherein the main axis is generally perpendicular to the orthogonal axes so that the top face rotates at a generally fixed circumductive angle with respect to the main axis;

a motor having a drive shaft; and a coupling assembly operably coupling the wedge wheel to the motor a base plate attached to the frame wherein the wedge wheel is rotatably attached to the base plate, the wedge wheel including a plurality of gear teeth therearound;

wherein the drive shaft includes a worm attached thereto; and wherein the coupling assembly includes:

a drive sprocket rotatably attached to the base plate and engaging the worm; and an endless drive chain engaging the wedge wheel at the plurality of gear teeth and the drive sprocket such that the rotation of the drive shaft effects rotation of the wedge wheel;

wherein the ischial pad engages and isolates the right and left ischial tuberosities and sacral area of a user seated in the chair and the peripheral member supports the user's body portions proximate the right and left ischial tuberosities.

7. The chair of claim 6 and further comprising:

a wobble plate attached to the ischial pad and rotatably mounted to the wedge wheel;

a first bearing assembly engaging the wobble plate and the wedge wheel; and a second bearing assembly engaging the base plate and the wedge wheel.

* * * * *